US005623752A

United States Patent [19]

Gillard et al.

[11] Patent Number: 5,623,752

[45] Date of Patent: Apr. 29, 1997

[54] FOLDABLE COFFIN

[75] Inventors: Alexandre Gillard, Lausanne; Alexandre Haas, Romanel-sur-Lausanne, both of Switzerland

[73] Assignee: Gerald Pidoux, Orbe, Switzerland

[21] Appl. No.: 436,439

[22] PCT Filed: Sep. 6, 1994

[86] PCT No.: PCT/CH94/00177

§ 371 Date: May 23, 1995

§ 102(e) Date: May 23, 1995

[87] PCT Pub. No.: WO95/08973

PCT Pub. Date: Apr. 6, 1995

[30] Foreign Application Priority Data

Sep. 28, 1993 [CH] Switzerland ..... 2920/93

[51] Int. Cl.[6] ..... A61G 17/00

[52] U.S. Cl. ..... 27/2; 229/183

[58] Field of Search ..... 229/165, 167, 229/117, 183, 185, 155; 27/2

[56] References Cited

U.S. PATENT DOCUMENTS

| | | | |
|---|---|---|---|
| 3,574,906 | 4/1971 | Rittenhouse | 27/4 |
| 4,059,221 | 11/1977 | Olson | 229/185 X |
| 4,123,831 | 11/1978 | Covington | 27/2 |
| 4,135,279 | 1/1979 | Covington | 27/4 |
| 4,151,630 | 5/1979 | Havey | 27/2 |
| 4,156,956 | 6/1979 | Partridge et al. | 27/4 |
| 4,392,607 | 7/1983 | Perkins | 229/39 R |
| 4,884,741 | 12/1989 | Nederveld | 229/157 |
| 4,953,782 | 9/1990 | Noland | 229/185 X |
| 5,139,196 | 8/1992 | Fry et al. | 229/185 X |
| 5,145,110 | 9/1992 | Terpstra | 229/185 X |

*Primary Examiner*—Carl D. Friedman
*Assistant Examiner*—Beth A. Aubrey
*Attorney, Agent, or Firm*—Clifford W. Browning; Woodard, Emhardt, Naughton, Moriarty & McNett

[57] ABSTRACT

The coffin is made by folding, along preformed lines, a single piece part (10) cut from a plate of corrugated cardboard of which at least one of the faces is covered with a cellulose coating which is tinted and decorated so as to give said face a wooden aspect. First the bottom of the coffin is formed by applying to each other two portions (1', 2') of different panels (1, 2) of the part (10) and by fixing said portions (1', 2') to each other by means of fixing tabs (3", 4") inserted into the slots (**26*a*, 26*b*). The lid is then formed by folding back one portion (1") of a side panel (1) to the tails (3''', 4''') extending from the extremity panels (3, 4) and by fixing said part (1") to the tails by means of fixing pieces inserted into pairs of corresponding openings (14*a*, 34*a*) and (15*a*, 45*a*) and, finally, by folding back a part (2") of the other side panel (2) onto the part (1") and by fixing said two parts (1", 2") to each other by means of fixing pieces inserted into pairs of corresponding openings (23, 13), (24*b*, 14*b*) and (25*b*, 15*b***). The disclosed coffin may be used both for burial and incineration purposes, without harmful effect to the environment.

9 Claims, 4 Drawing Sheets

FOLDABLE COFFIN

SUMMARY OF THE INVENTION

The present invention is concerned with a foldable coffin.

The invention is in particular aimed at providing a light-weight coffin, which when folded requires only little space, to facilitate its transport, while being very easy to assemble, without any tool and in any situation, and providing a rigid structure of a high strength.

The invention is also aimed at providing a coffin which can be used both for burial and for incineration, without any short term, medium term and long term adverse effects on the environment.

Another aim of the invention is to provide a coffin made of a material which is readily biodegradable.

To this end, the coffin according to the invention has the characteristic features that follow: A foldable coffin, characterized in that it is made by folding a blank cut out as a single piece from a sheet consisting substantially of cellulosic material, to form a plurality of panels providing the faces of the wall of the coffin, as well as assembling and reinforcing members for this wall, this blank exhibiting a plurality of preformed folding lines between the panels and parts thereof corresponding to the different faces of the wall of the coffin, as well as a plurality of openings arranged in such a manner that, upon folding and turning down of the different parts of said panels over one another, the respective openings of at least two of these panels are made to coincide with one another to make it possible to fasten together the panels by means of fastening members, arranged to be introduced through the openings while occluding the same and maintaining the edges thereof together. Additional optional characteristic features will be evident from the description of the invention that follows.

Advantageously, the material used for forming the walls of the coffin is in the form of a sheet, comprised of an inner part made of corrugated cardboard covered, on at least one of the two faces of the sheet, by one or several layers of a cellulosic coating material, colored and optionally decorated, for example to confer to the surface of the material the appearance or wood.

Preferably, the cellulosic material forming the coating layer or layers covering the two faces of the material consists of pure natural cellulose which had undergone no treatment by a chemical agent such as chlorine, fluorine, hydrochloric acid, hydrofluoric acid or chlorinated or fluorinated bleaching agents, this layer being stained by printing with a water colour and, optionally, slightly weathered by exposure to ultraviolet radiations.

The inner corrugated part of the sheet is preferably made of recycled paper, which was washed with water, without being subjected to any hydrochloric or hydrofluoric bleaching, and is assembled by means of an environmentally neutral adhesive.

The containment case which can be used inside the coffin is advantageously made of a material consisting of a base of corrugated recycled cardboard covered, on one face thereof designed for becoming the inner surface of the wall of the containment ease, by a thin film of polyester having, for example, a thickness in the order of 5 to 10 micrometers. Such a material is designed for resisting to corrosive liquids, in particular to the products generated by the decomposition of the corpse, such as amino acids, this material being however biodegradable per se and capable of withstanding without deformation, temperatures ranging from those of liquid nitrogen (approximately −180° C.) to a maximum value in the order of +240° C.

BRIEF DESCRIPTION OF THE DRAWING FIGURES

The invention will be better understood from the following detailed description of an exemplary embodiment of the coffin, with reference to the annexed drawing, in which:

FIG. 1 shows the shape of a blank designed for forming the walls of the coffin, obtained by cutting out from a sheet of corrugated cardboard and forming of folding lines;

FIGS. 2*a* to 2*f* show the different steps of the assembling and closing of the coffin from the blank shown in FIG. 1;

FIGS. 3*a* and 3*b* show a fastening member designed for holding together the different parts of the blank of FIG. 1 when assembling and closing the coffin;

FIGS. 4*a*, 4*b* and 4*c* show a containment case for the liquid, designed for placement inside the coffin.

DETAILED DESCRIPTION OF THE PREFERRED EMBODIMENT

Figure 1:
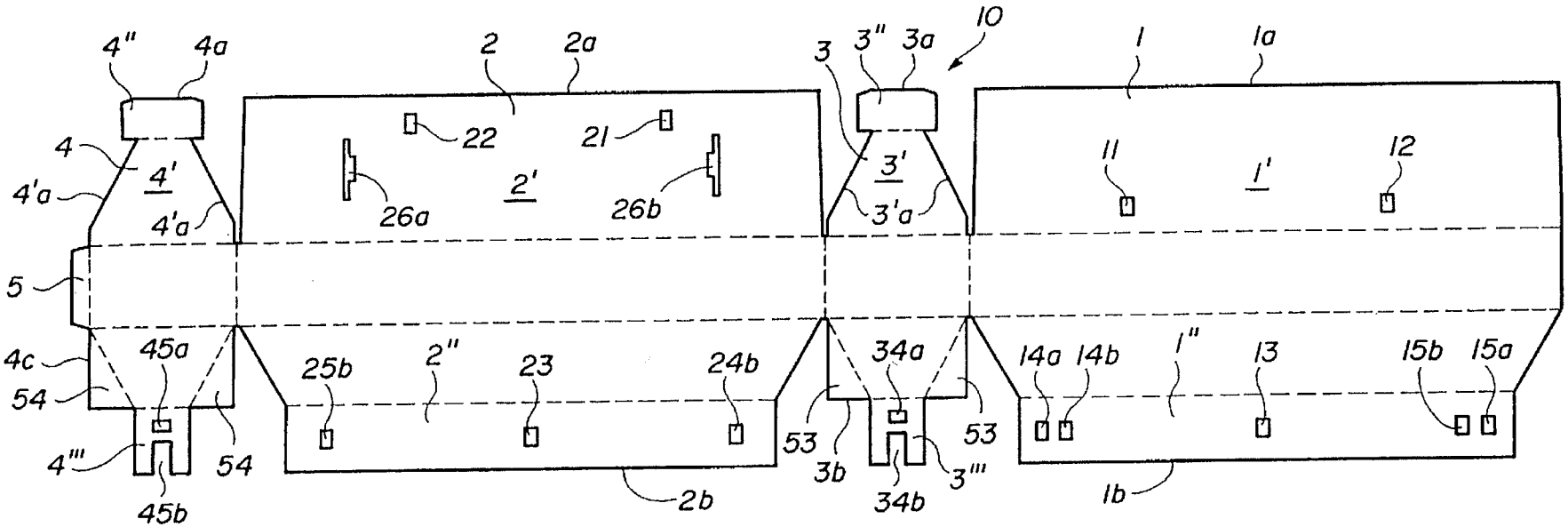

The blank 10 illustrated in FIG. 1, includes two panels 1 and 2, designed for providing the bottom, the side walls and the cover of the coffin and two panels 3 and 4 designed basically for forming the end walls thereof. The blank 10 is all of one piece and is advantageously formed by die stamping, from a sheet of corrugated cardboard.

Panel 1 is provided with two small rectangular openings 11 and 12 aligned in a parallel direction to its upper edge 1*a*, in the upper part 1' of panel 1, as well as a series or rectangular openings aligned in a parallel direction to the lower edge 1*b* and in the vicinity thereof, in the lower part 1" of panel 1. More specifically, these openings are comprised of a central opening 13 and of two groups of openings 14*a*, 14*b* and 15*a*, 15*b* placed symmetrically with respect to the opening 13.

Panel 2 is provided with two rectangular openings 21 and 22 aligned in a parallel direction to its upper edge 2*a* and located in the vicinity thereof, in the upper part 2' of panel 2, and of three rectangular openings 23, 24*b* and 25*b*, aligned in a parallel direction to its lower edge 2*b* and located in the vicinity of the latter, in the lower part 2" of panel 2.

All these rectangular opening have the same dimensions.

Panel 2 is furthermore provided with two elongated slots 26*a* and 26*b*, arranged symmetrically with respect to each other. Panels 3 and 4 are substantially identically shaped and dimensioned, except for the fact that panel 4 includes a side tab 5 on its free edge 4*c*.

The upper parts, respectively 3' and 4', of the panels 3 and 4 are substantially triangular and become narrower in the direction of their respective upper edges 3*a* and 4*a*. However, these parts 3' and 4' of the panels 3 and 4 expand again in the vicinity of the edges 3*a* and 4*a* by forming each one an end tab 3" and 4", of which the edges form, at their junction with the edges 3'*a* and 4'*a* of the triangular parts 3' and 4', sort of hooks, of which the function will be described later.

The respective appendices 3''' and 4''', of a generally rectangular shape, extend downwards of the panels 3 and 4, beyond the lower edges 3*b* and 4*b* of the latter.

The appendix 3''' is provided with a rectangular opening 34*a*, of the same dimensions as the above-mentioned openings 11, 12 . . . 25*b* and with a notch 34*b*, having the shape of an U, of which the width is equal to the length of the opening 34*a*, and of which the side edges are aligned with the shorter sides of this opening.

In the same manner, the appendix 4''' is provided with an opening 45*a*, similar to opening 34*a* and with a notch 45*a* similar to notch 34*b*.

For storing and transporting the blank 10, the panel 4 is folded over the panel 2, and the panel 1 is subsequently folded in such a manner as to cover the panels 3 and 2 as well as the face of tab 5 of panel 4 opposite to the one apparent in FIG. 1. In this configuration, tab 5 is fastened to the surface of panel 1, apparent in FIG. 1, in the vicinity of the free edge 1*c* of the latter. This operation is carried out advantageously by adhesive bonding, in such a manner as to avoid that fastening means be apparent on the outer face of the panel 1.

The blank 10 is then assembled and folded in a collapsed form and piles can be formed including each one a certain number of these blanks, for example ten, for their storage and transport.

The assembling of the coffin will now be described with reference to FIGS. 2*a* to 2*f*.

Figure 2C:
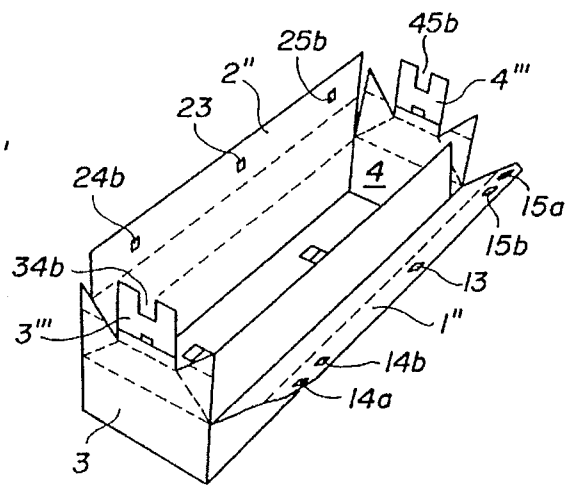
Figure 2B:
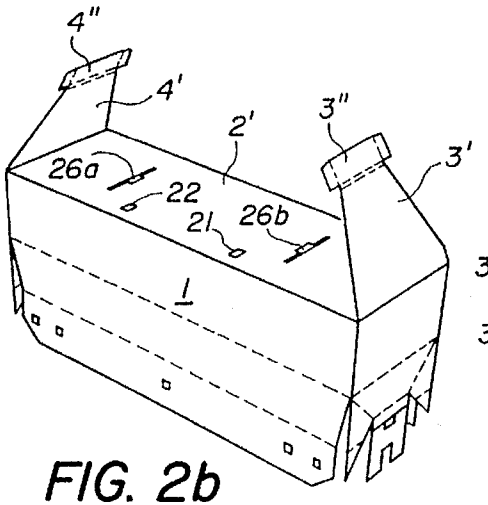
Figure 2A:
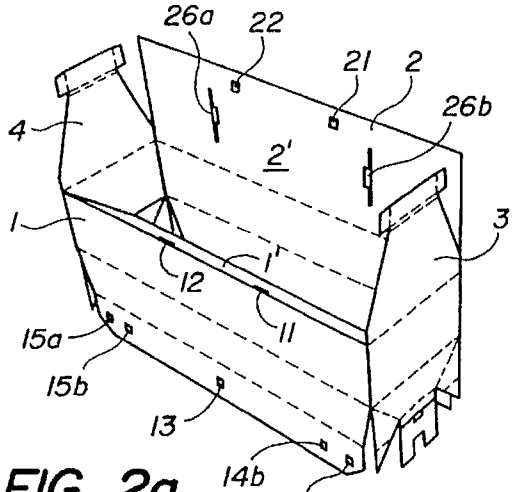

The first step of the assembling, illustrated in FIG. 2*a*, consists in unfolding the blank 10 in such a manner that the panels 3 and 4 forming the end walls be perpendicular to the panels 1 and 2 forming the side walls and in folding downwards and along a preformed folding line, the upper part 1' of the panel 1, designed for providing the inner wall of the bottom of the coffin.

In the second step of the assembling, illustrated in FIG. 2*b*, the upper part 2' of the panel 2 is folded over the upper part 1' of the panel 1, and then the respective upper parts 3' and 4' of the panels 3 and 4 are folded over the part 2' of panel 2 previously folded down and they are affixed thereto by introducing the tabs 3" and 4" into the slots 26*b* and 26*a*, respectively.

Finally, the bottom of the coffin is completed by applying one against the other, the upper part 1' of panel 1 (which is on the inside) and the upper part 2' of the panel 2 (which forms the outer side of the bottom of the coffin) and by fastening them together by means of fastening members (the construction and the operation of which will be given in detail later in the description) extending through, on the one hand, the openings 21 and 11 and, on the other hand, the openings 22 and 12, which are made to coincide respectively, when part 1' of the panel 1 is applied against part 2' of panel 2.

The bottom of the coffin is thus constructed as a double wall and the remainder of the blank 10 then provides a case which is rigid.

Blank 10 is then turned over as illustrated in FIG. 2*c*, to allow the introduction of the liquid containment case (not illustrated in FIG. 2*c*) into the coffin.

The coffin is then ready to receive the corpse, advantageously placed on a bed of an absorbing material placed into the liquid containment case.

Figure 2F:
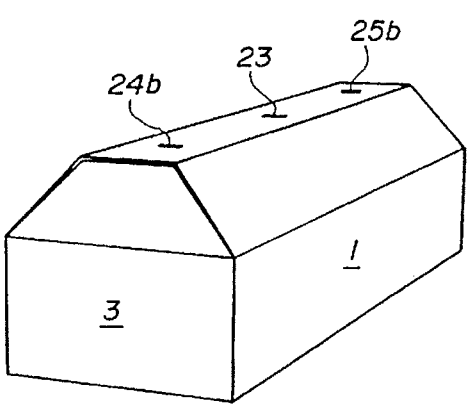
Figure 2E:
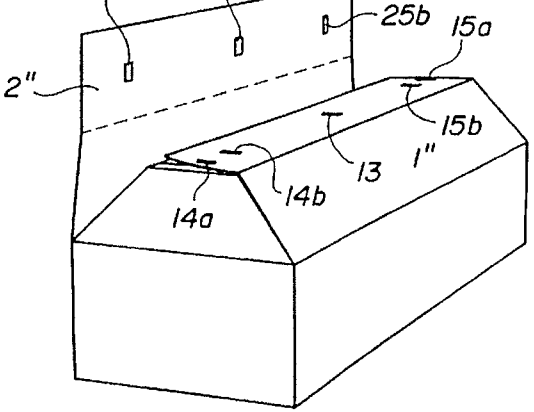
Figure 2D:
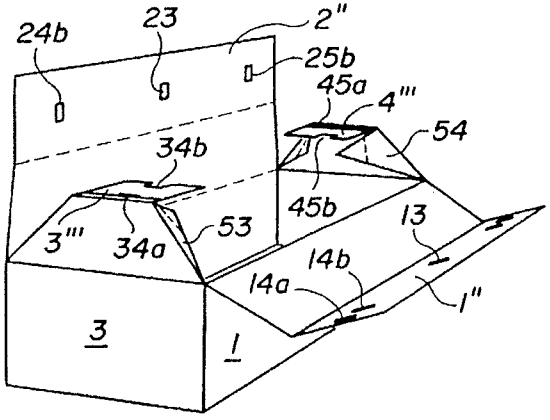

FIG. 2*d* illustrates the first step of the closing of the coffin, which can also be considered as being the fourth step of the assembling.

During this step, on the one hand, the respective appendices 3''' and 4''' of the panels 3 and 4 are folded, so as to place them practically into a horizontal plane and, on the other hand, the side flaps 53 and 54 are folded inwards, which flaps are provided, respectively, between the corners of the parts of the panels 3 and 4 adjoining the appendices 3''' and 4''' and the folding lines indicated in FIG. 1, and the inward folding of the lower part 1" of the panel 1 is initiated.

The second step of closing (fifth step of the assembling) illustrated in FIG. 2*e*, consists in folding part 1" of the panel 1, in such a manner as to apply the same horizontally on the appendices 3''' and 4''' of the panels 3 and 4, while superposing the openings 14*a* and 34*a*; 14*b* and 34*b*; 15*a* and 45*a*; 15*b* and 45*b*. The appendix 3''' is then fastened to part 1" of the panel 1, by means of a fastening member identical to that used, as indicated above, for the mutual fastening of the respective upper parts 1' and 2' of the panels 1 and 2, this fastening member extending through the openings 14*a* and 34*a*. Similarly, the appendix 4" is fastened to the part 1" of the panel by means of another fastening member, also of the same type, extending through the openings 15*a* and 45*a*.

To complete the closing of the coffin, one only needs, as illustrated in FIG. 2*f*, to fold down part 2" of panel 2 including the series of openings 23, 24*b* and 25*b*, on part 1" of panel 1, said openings being then made to coincide with the respective openings 13, 14*b* and 15*b* of the later and then to fasten these two parts together, by means of three fastening members, again of the above-mentioned type, extending respectively through the pairs of openings 23 and 13; 24*b*, 14*b*; 25*b* and 15*b*.

The coffin is thus erected and closed simply and rapidly by shaping blank 10 to form a perfectly rigid structure.

Figure 3B:
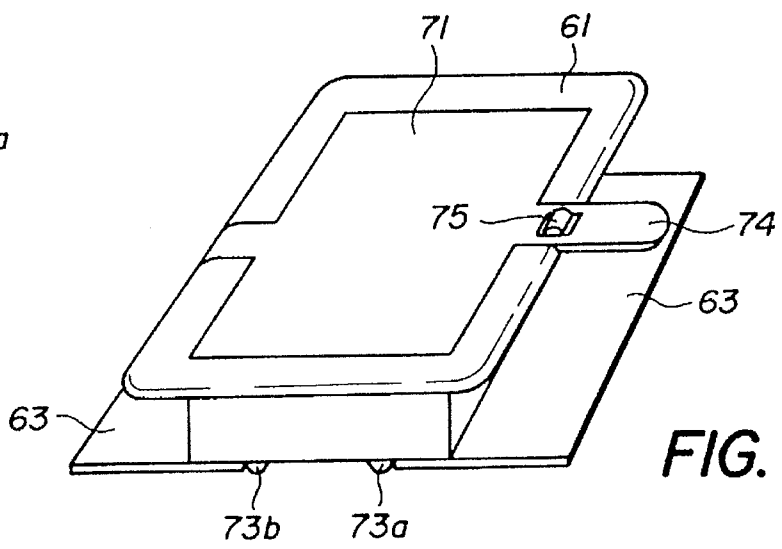
Figure 3A:
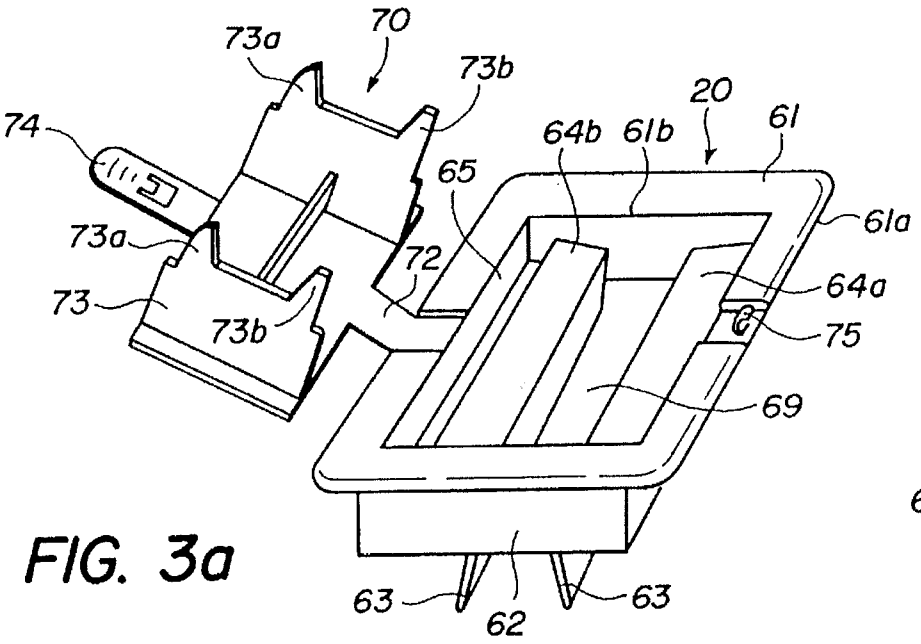

We shall now describe the arrangement and the operation of the above-mentioned fastening member, with reference to FIGS. 3*a* and 3*b*.

The fastening member 20, represented in FIGS. 3*a* and 3*b* includes a rectangular flat frame 61 of which the external edges 61*a* extend beyond a vertical wall 62, of which the inner surface is defined on one side by the inner edges 61*b* of frame 61.

Preferably, the fastening member is made entirely of a plastic material which can be eliminated without any adverse effect on the environment, such as low pressure, high-density polyethelene (HDPE). The frame (61) and the walls (62) are advantageously integrally molded from such a plastic material.

The space defined by the wall 62 inside the frame 61, forms a housing 69 opened at the top and at the bottom, into which are placed two movable flaps 63 running parallel to the length of frame 61, each one of them being fastened to a pedal 64*a* or 64*b* forming therewith a substantially right-angled dihedron.

The pedals 64*a* and 64*b* are each one connected to the corresponding inner face 65 of the wall 62 by a flexible connection forming a hinge enabling the corresponding pedal/flap assembly to pivot.

The upper opening of the housing 69 can be closed by a cover 70 including a rectangular obturating plate 71, which is shaped and dimensioned so as to fit snugly inside the opening defined by the inner edges 61*b* of the frame 61, this plate 71 being connected to frame 61 by a flexible strip 72.

Furthermore, the cover 70 includes two walls 73 perpendicular to the plate 71, and carrying each one two cams 73*a* and 73*b*, which are shaped and dimensioned so that, when the cover 70 is placed in a position to close the housing 69, as illustrated in FIG. 3*b*, the cams 73*a* and 73*b* cause respectively and successively the pivoting of the pedals 64*a* and 64*b* to immobilize the same in a vertical position against the corresponding inner face 65 of the wall 62. The effect of this is to put the flaps 63 into a horizontal position and to immobilize them in this position. A tab 74 makes it possible to easily operate the cover 70.

As can be seen in FIG. 3*b*, when the piece 20 is inserted into coinciding rectangular openings of two or even of three cardboard plates to be assembled together, these openings having a shape corresponding to that of the vertical wall 62 and the piece 20 being upon this insertion in the configuration illustrated in FIG. 3*a*, one only needs to place the cover 70, for the piece 20 to assume the configuration illustrated in FIG. 3*b*, while fastening said plates together by clamping them between the edges of the frame 61 and the flaps 63.

As is apparent in FIG. 3*b*, the obturating plate 71 of the cover 70 is then locked by attaching tab 74 by means of a hook 75 provided on the frame 61.

Figure 4A:
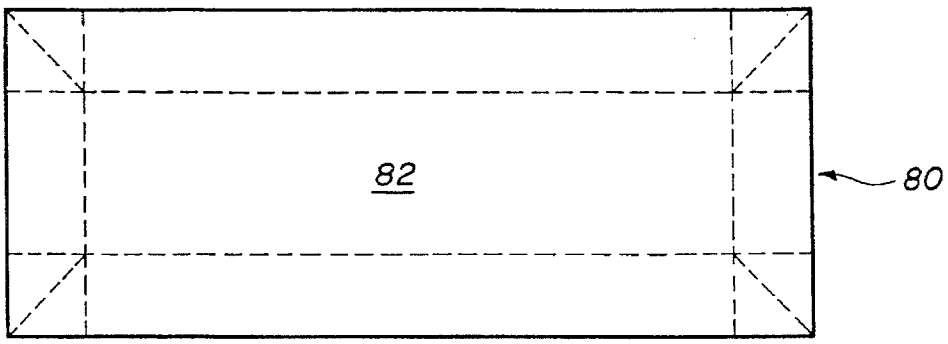
Figure 4B:
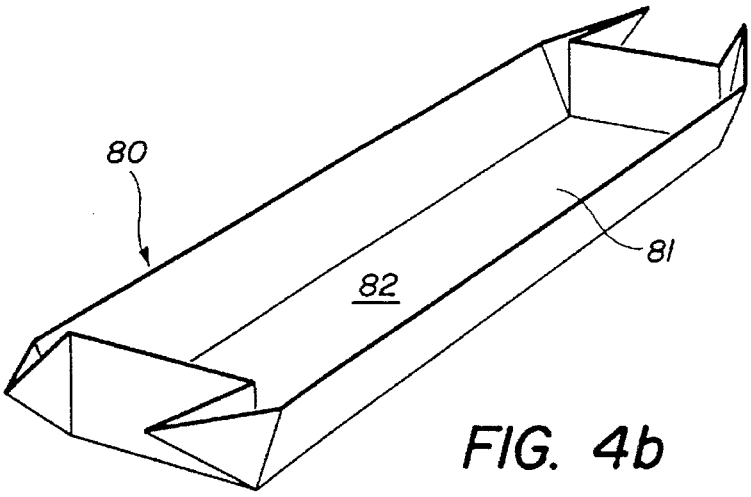
Figure 4C:
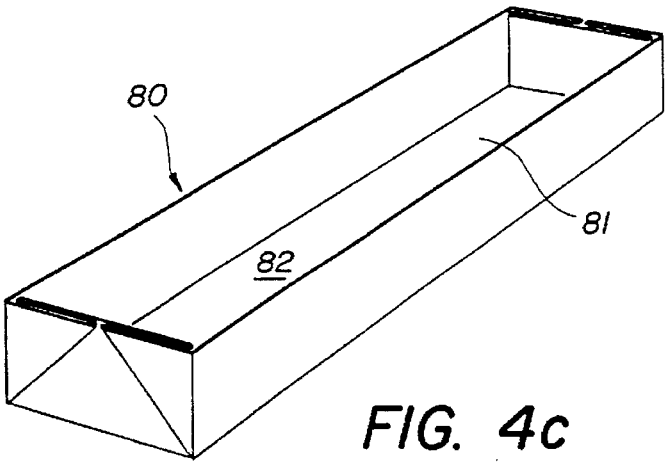

As illustrated in FIGS. 4*a* to 4*c*, a case 80 for the containment of liquids is made simply by folding a rectangular blank 81 cut out from a sheet based on corrugated cardboard, of which a face 82, designed for forming the inside of the case 80, is covered by a film of polyester having a thickness of 6 microns.

The folding is carried out on the flat blank 81 shown in FIG. 4*a*, via the intermediate configuration shown in FIG. 4*b*, along the folding lines preformed when the blank 81 is cut out, in such a manner as to form a rectangular case 80 (FIG. 4*c*) the shape of which is maintained owing to the support offered by the internal walls of the coffin, once the case is positioned.

The coffin which has been described is particularly lightweight and resistant. For example, with a thickness of 7.5 mm for the outer walls of the coffin and 4 mm for the walls of the liquid containment case, the total weight of a coffin of usual dimensions is about 12 kg and the maximum load which coffin can withstand amounts to a value in the order of 200 kg, including an optional bed of absorbing material.

We claim:

1. A container made of a single sheet of substantially cellulosic material, said sheet comprising a plurality of panels for forming the bottom, the sidewalls and the cover of the container, as well as assembling and reinforcing portions and having pre-formed folding lines and a plurality of pairs of openings arranged for becoming superposed in the folded state of the container, fastening members of plastic material for fastening together corresponding portions of said sheet being inserted into respective pairs of said openings so as to occlude the same and maintain the edges thereof together, said openings being of rectangular shape and said fastening members have a body part comprising rectangulary arranged side wall portions adapted for fitting into said openings, and further have a flat frame portion surrounding first edges of said side wall portions, two movable flaps hinged connected, through respective pedal means, to two opposite ones of said side wall portions, and a cover part comprising cam portions arranged for actuating said pedal means to bring said movable flaps into a position where they extend beyond second edges of said wall portions in a direction parallel to said flat frame portion when said cover part is placed on said body part in a closing position.

2. A container according to claim 1, wherein said sheet comprises first and second side panels having respective elongated foldable bottom portions for forming the bottom of the container, said bottom portions being turned down and applied against each other so as to overlap one another, at least one of said bottom portions having at least one fastening slot, said piece further comprising first and second end panels having reinforcing and fastening portions, at least one of said fastening portions comprising a fastening tab inserted into said fastening slot of a bottom portion, said bottom portions further having at least one pair of said superposed openings with a said fastening member inserted therein.

3. A container according to claim 1, wherein said sheet comprises first and second side panels and first and second end panels, said side panels comprising, respectively, first and second cover portions and said end panels comprising, respectively, first and second mounting appendices, said first cover portion being applied on said first and second mounting appendices, said first cover portion and said first and second mounting appendices having corresponding pairs of said superposed openings with a said fastening member inserted therein, said second cover portion being turned down on said first cover portion, said second cover portion and said first cover portion having corresponding pairs of said superposed openings with a said fastening member inserted therein.

4. A container according to claim 1, wherein said sheet comprises a sheet of corrugated cardboard.

5. A container according to claim 1, wherein said sheet is covered, on at least one of its faces, by a coating comprised of pure natural cellulose.

6. A container according to claim 1, wherein said fastening members are made of a plastic material capable of being eliminated without adverse effect on the environment.

7. A container according to claim 1, wherein said plastic material consists of low-pressure high-density polyethylene (HDPE).

8. A container according to claim 1, wherein a liquid containment case is placed inside the coffin, on the bottom thereof.

9. A container according to claim 1, wherein said containment case is formed of a folded rectangular sheet of corrugated cardboard covered, on its inner surface, with a coating of a plastic material resistant to the compounds generated by the decomposition of a corpse.

* * * * *

UNITED STATES PATENT AND TRADEMARK OFFICE

CERTIFICATE OF CORRECTION

PATENT NO. : 5,623,752

DATED : April 29, 1997

INVENTOR(S) : Alexandre Gillard, Alexandre Haas

It is certified that error appears in the above-identified patent and that said Letters Patent is hereby corrected as shown below:

On the title page:

At Item [73] please insert --Part Interest-- between "Pidoux," and "Orbe".

In column 1, line 61, please delete "ease" and insert in lieu thereof --case--.

Signed and Sealed this

Third Day of February, 1998

*Attest:*

BRUCE LEHMAN

*Attesting Officer*

*Commissioner of Patents and Trademarks*